US008640656B1

(12) United States Patent
Vann et al.

(10) Patent No.: US 8,640,656 B1
(45) Date of Patent: Feb. 4, 2014

(54) SELF-SUSTAINING BOILER SYSTEM

(76) Inventors: Woody Vouth Vann, Ogilvie, MN (US); Sitha Sarin, Ogilvie, MN (US)

( * ) Notice: Subject to any disclaimer, the term of this patent is extended or adjusted under 35 U.S.C. 154(b) by 946 days.

(21) Appl. No.: 12/714,456

(22) Filed: Feb. 27, 2010

(51) Int. Cl.
*F22B 31/00* (2006.01)

(52) U.S. Cl.
USPC ..... 122/209.1; 122/214; 122/332; 122/30; 122/262; 122/235.14; 110/101 C; 110/118; 110/203; 110/215; 432/192; 96/329; 96/332; 96/333; 96/337; 96/339; 96/245; 96/251

(58) Field of Classification Search
USPC ..... 110/116, 117, 327, 101 C, 101 R, 118, 110/286–294, 215; 122/30, 203–217, 122/13.01, 289, 322, 334, 338–240, 349, 122/367.1, 37, 262; 432/19, 192, 72; 96/243–371
See application file for complete search history.

(56) References Cited

U.S. PATENT DOCUMENTS

| | | | | | |
|---|---|---|---|---|---|
| 387,196 | A * | 7/1888 | Winsor | 122/338 |
| 717,915 | A * | 1/1903 | Penney | 122/340 |
| 3,265,038 | A * | 8/1966 | Vuia | 122/2 |
| 3,395,657 | A * | 8/1968 | Schuss | 110/189 |
| 3,984,219 | A * | 10/1976 | Huang | 96/262 |
| 4,044,727 | A * | 8/1977 | Rychen et al. | 122/449 |
| 4,137,905 | A * | 2/1979 | Longworth | 122/18.4 |
| 4,257,557 | A * | 3/1981 | Thomasma et al. | 237/19 |
| 4,348,968 | A * | 9/1982 | Demar | 110/341 |
| 4,444,538 | A * | 4/1984 | Manley | 414/173 |
| 4,531,461 | A * | 7/1985 | Sayler et al. | 110/106 |
| 4,565,184 | A * | 1/1986 | Collins et al. | 122/16.1 |
| 4,583,999 | A * | 4/1986 | Lindahl et al. | 95/199 |
| 4,676,199 | A * | 6/1987 | Daugirda et al. | 122/13.01 |
| 4,843,979 | A * | 7/1989 | Phillips | 110/215 |
| 5,004,486 | A * | 4/1991 | Chen | 96/240 |
| 5,358,540 | A * | 10/1994 | Tsan-Yun et al. | 96/235 |
| 5,415,133 | A * | 5/1995 | Noh | 122/13.01 |
| 5,437,002 | A * | 7/1995 | Bennett | 392/441 |
| 5,507,574 | A * | 4/1996 | Dickey | 366/213 |
| 6,164,220 | A * | 12/2000 | Magnusson | 110/246 |
| 6,415,744 | B1 * | 7/2002 | Choi | 122/18.1 |
| 7,458,564 | B2 * | 12/2008 | Paxton et al. | 261/79.2 |
| 7,490,580 | B2 * | 2/2009 | Hanai et al. | 122/31.1 |
| 7,497,172 | B2 * | 3/2009 | Breen et al. | 110/345 |
| 7,621,227 | B2 * | 11/2009 | Sterr | 110/297 |
| 7,841,282 | B2 * | 11/2010 | Kimberlin et al. | 110/101 C |
| 7,985,343 | B2 * | 7/2011 | Haldopoulos et al. | 210/767 |
| 8,011,329 | B2 * | 9/2011 | Hardy | 122/16.1 |
| 8,016,271 | B2 * | 9/2011 | Dulphy et al. | 261/87 |
| 2003/0037678 | A1 * | 2/2003 | Payne et al. | 96/245 |
| 2008/0003158 | A1 * | 1/2008 | Raoux et al. | 423/239.1 |
| 2008/0014134 | A1 * | 1/2008 | Raoux et al. | 423/241 |
| 2010/0071634 | A1 * | 3/2010 | Kim | 122/235.14 |
| 2010/0119420 | A1 * | 5/2010 | Chandler et al. | 422/171 |
| 2011/0104624 | A1 * | 5/2011 | Terushita et al. | 431/12 |

* cited by examiner

*Primary Examiner* — Steven B McAllister
*Assistant Examiner* — Ko-Wei Lin
(74) *Attorney, Agent, or Firm* — Dave Alan Lingbeck

(57) ABSTRACT

A self-sustaining boiler system for generating usable energy and heat without creating pollution. The self-sustaining boiler system includes a boiler capable of generating efficient usable energy and heat, and also includes an exhaust purifying assembly being in fluid communication to the boiler for removing the pollutants from the exhaust generated by the boiler, and further includes a fuel source assembly being in fluid communication to the boiler for providing fuel to the boiler.

16 Claims, 4 Drawing Sheets

SELF-SUSTAINING BOILER SYSTEM

BACKGROUND OF THE INVENTION

1. Field of the Invention

The present invention relates to boilers and more particularly pertains to a new self-sustaining boiler system for generating usable energy and heat without creating pollution.

2. Description of the Prior Art

The use of boilers is known in the prior art. More specifically, boilers heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a boiler having a steam collector drum with a plurality of heat exchange tubes with the tubes being interchangeable. Another prior art includes a boiler having a water jacket formed by a series of water-carrying pipes for holding the wood with an exhaust pipe extending through the top of the water jacket and with a return duct for returning condensates to the combustion chamber. Yet, another prior art includes a wood-burning boiler with a combustion chamber having a first air intake with an exhaust chamber being fluidly coupled to the combustion chamber, and with a preheat chamber being fluidly coupled to the combustion chamber and with a water jacket being conductively proximate to the combustion chamber.

While these devices fulfill their respective, particular objectives and requirements, the aforementioned patents do not disclose a new self-sustaining boiler system.

SUMMARY OF THE INVENTION

The general purpose of the present invention, which will be described subsequently in greater detail, is to provide a new self-sustaining boiler system which has many of the advantages of the boilers mentioned heretofore and many novel features that result in a new self-sustaining boiler system which is not anticipated, rendered obvious, suggested, or even implied by any of the prior art boilers, either alone or in any combination thereof. The present invention includes a boiler capable of generating efficient usable energy and heat, and also includes an exhaust purifying assembly being in fluid communication to the boiler for removing the pollutants from the exhaust generated by the boiler, and further includes a fuel source assembly being in fluid communication to the boiler for providing fuel to the boiler. None of the prior art includes the combination of the elements of the present invention.

There has thus been outlined, rather broadly, the more important features of the self-sustaining boiler system in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new self-sustaining boiler system which has many of the advantages of the boilers mentioned heretofore and many novel features that result in a new self-sustaining boiler system which is not anticipated, rendered obvious, suggested, or even implied by any of the prior art boilers, either alone or in any combination thereof.

Still another object of the present invention is to provide a new self-sustaining boiler system for generating usable energy and heat without creating pollution.

Still yet another object of the present invention is to provide a new self-sustaining boiler system that is easy to assemble and to adjust to regulate the energy and heat being produced by inserting or removing layers of heat conductive panels.

Even still another object of the present invention is to provide a new self-sustaining boiler system that automatically feeds the boiler with the fuel needed to operate the boiler at the desired efficient energy and heat levels.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
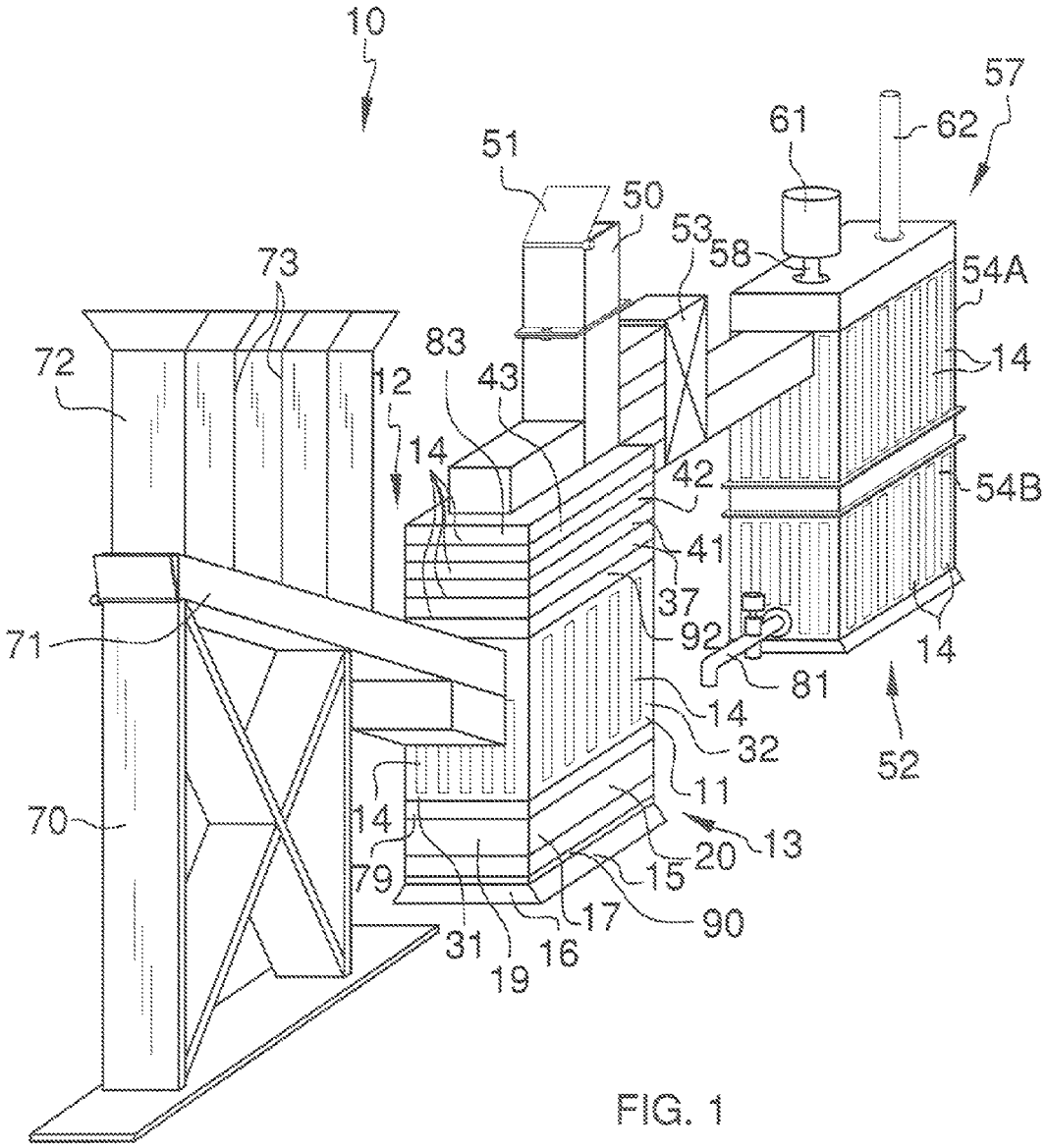
FIG. 1 is a front perspective view of a new self-sustaining boiler system according to the present invention.
Figure 2:
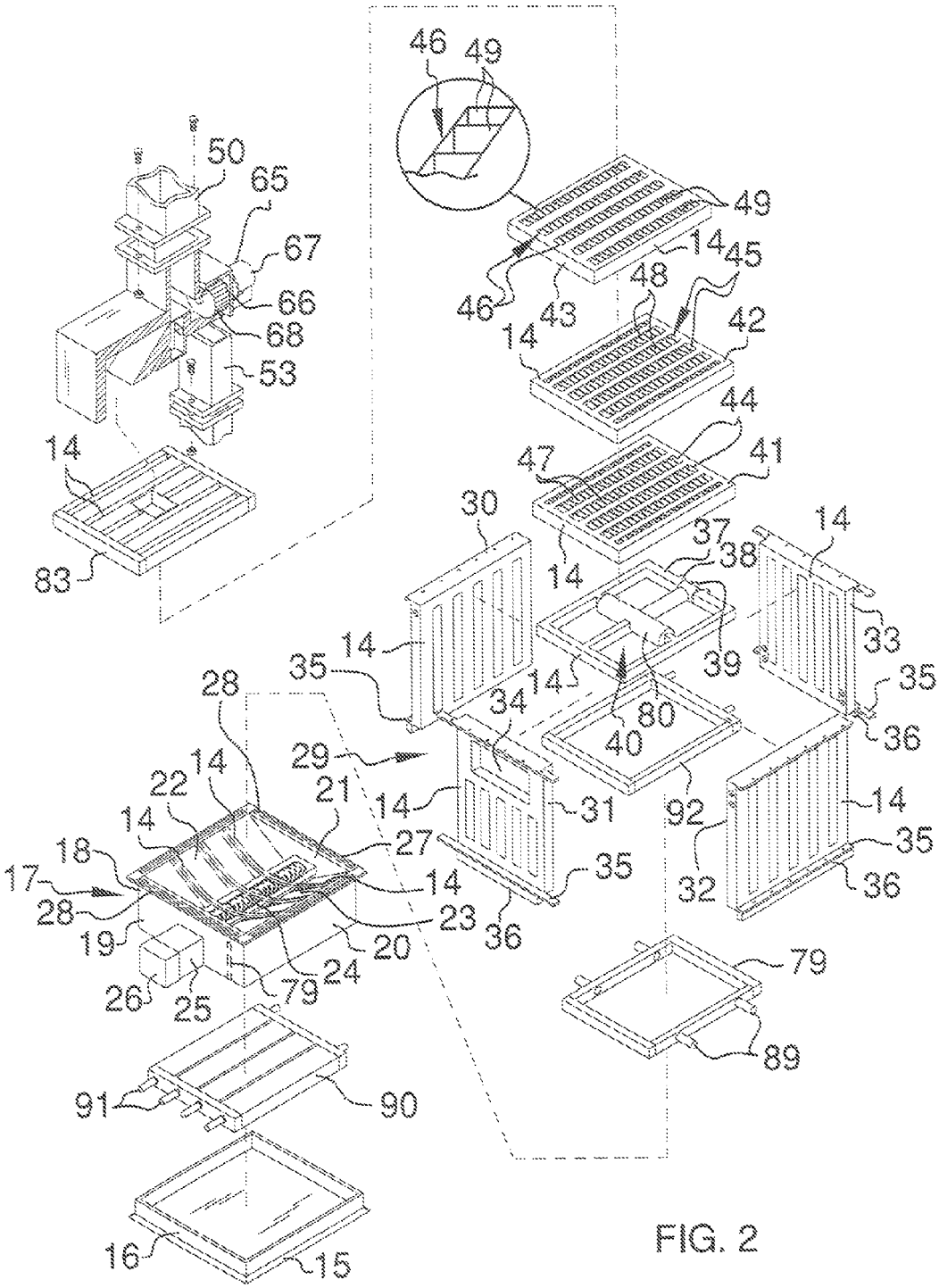
FIG. 2 is an exploded perspective view of the boiler assembly of the present invention.
Figure 3:
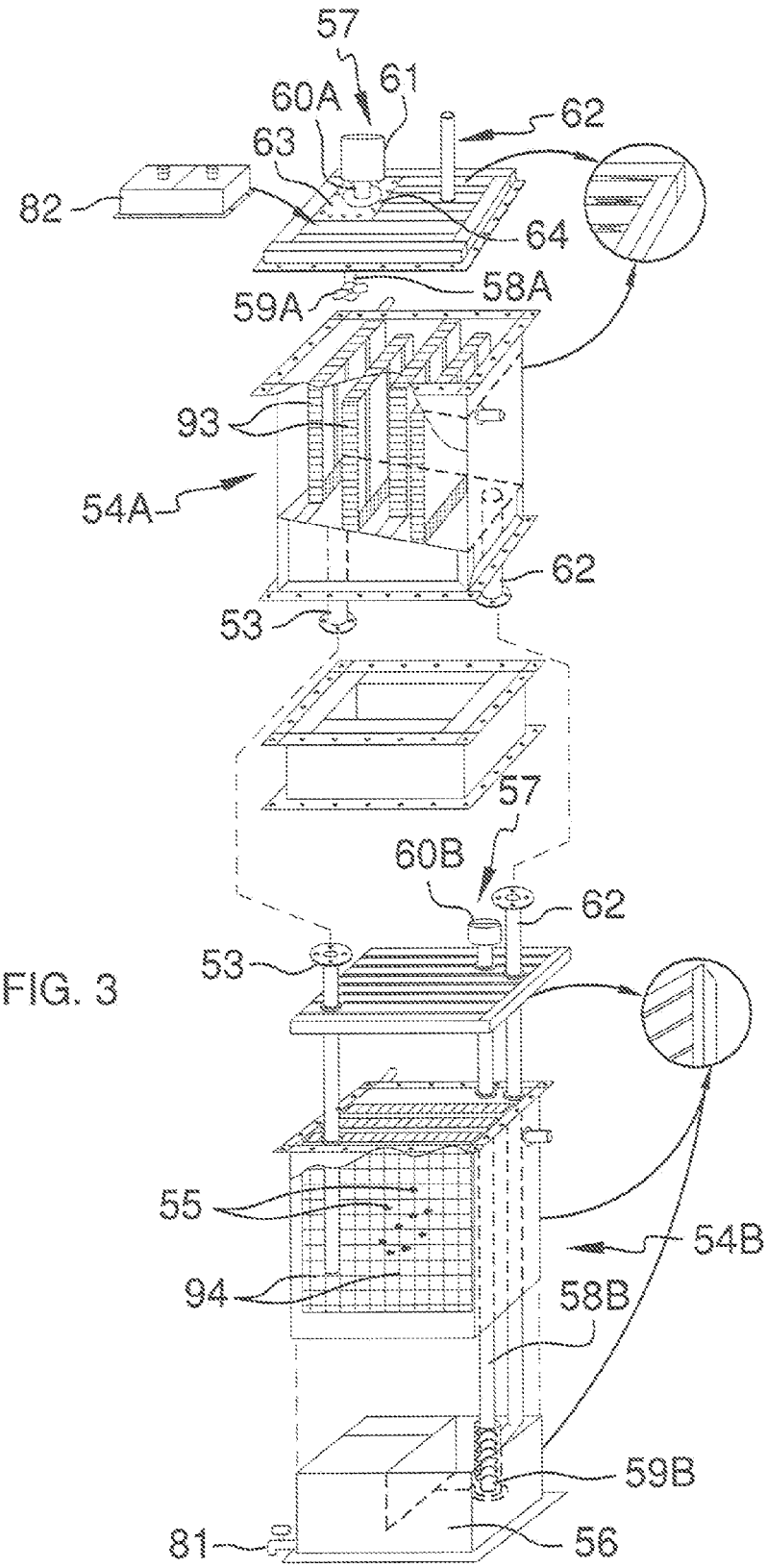
FIG. 3 is an exploded perspective view of the exhaust purifying assembly of the present invention.
Figure 4:
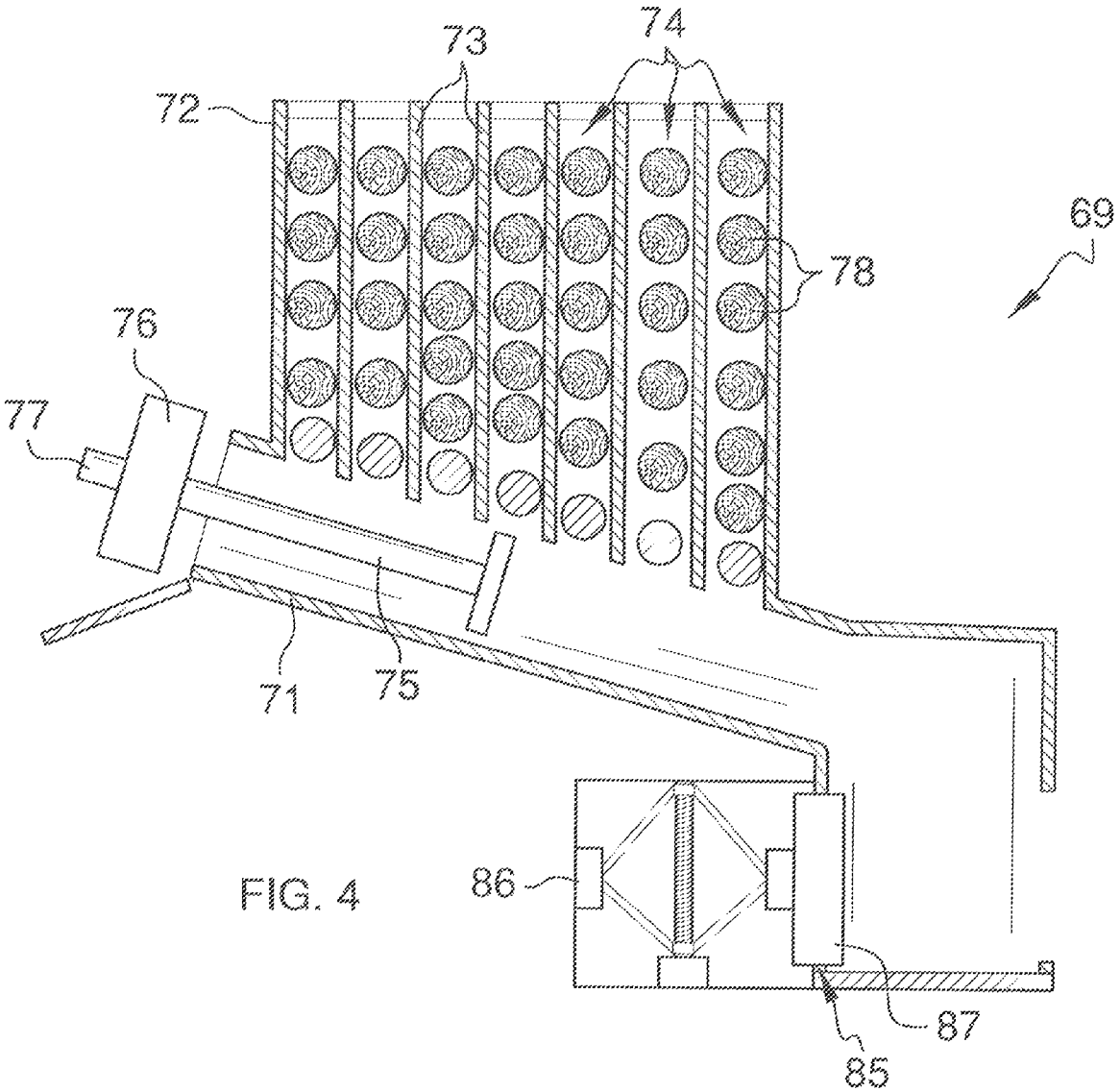
FIG. 4 is a perspective view of the fuel injecting assembly of the present invention.

With reference now to the drawings, and in particular to FIGS. 1 through 4 thereof, a new self-sustaining boiler system embodying the principles and concepts of the present invention and generally designated by the reference numeral 10 will be described.

As best illustrated in FIGS. 1 through 4, the self-sustaining boiler system 10 generally comprises a boiler 11 capable of generating efficient usable energy and heat, and also comprises an exhaust purifying assembly 52 being in fluid communication to the boiler 11 for removing the pollutants from the exhaust generated by the boiler 11, and further comprises a fuel source assembly 69 being in fluid communication to the boiler 11 for providing fuel to the boiler 11.

The boiler 11 has upper and lower sections 12,13 all of which are in fluid communication, and also has a plurality of pipes 14 being conventionally disposed in the upper and lower sections 12,13 with water being carried in the pipes 14 and with the pipes 14 being fluidly coupled throughout the upper and lower sections 12,13. The lower section 13 include a fuel-processing assembly 17, a tray 16 being removably disposed beneath the fuel-processing assembly 17 for receiving refuse from burning fuel, and a fuel combustion chamber 29 being detachably and conventionally mounted upon the fuel-processing assembly 17.

The fuel-processing assembly 17 includes side walls 18-21 being detachably and conventionally attached end to end to form an enclosure having an open top and having flanges 27 being conventionally disposed about the open top and having longitudinal slots 28 being disposed therethrough. The fuel-processing assembly 17 also includes slides 22,23 being spaced apart and being detachably and conventionally attached to the side walls 18-21 and being disposed within the enclosure, and further includes a plurality of the pipes 14 being conventionally disposed in the side walls 18-21 and the slides 22,23. The pipes 14 are fluidly coupled to one another with water flowing through the pipes 14. The fuel-processing assembly 17 also includes a burner section 79 including torch members 89 being conventionally supported upon the enclosure to ignite and burn the fuel 78. The fuel-processing assembly 17 also includes a refuse removal assembly 24-26 being conventionally disposed near a bottom of the fuel-processing assembly 17 for removing the refuse to the tray 16. The refuse removal assembly 24-26 includes an auger 24 extending within the enclosure and being disposed between and below the slides 22,23 with the slides 22,23 being slanted upwardly away from the auger 24, and also includes an actuator 25 such as a motor being conventionally connected to the auger 24 to energize the auger 24 to remove the refuse from the enclosure to the tray 16. The refuse removal assembly 24-26 further includes a processing unit 26 being conventionally connected to the actuator 25 and being programmed to activate and deactivate the actuator 25 for removing the refuse from the enclosure to the tray 16. The fuel processing assembly also includes a heating element section 90 being conventionally disposed upon the tray 16. The heating element section 90 includes a plurality of pipes 14 for carrying water and also includes heating elements 91 being programmed to provide heat to outside means and uses.

The fuel combustion chamber 29 includes side walls 30-33 being detachably and conventionally attached end to end to form a hollow enclosure and being detachably mounted upon and in fluid communication with the fuel-processing assembly 17. The hollow enclosure has flanges 35 being conventionally disposed about an open bottom thereof and about a bottom of the side walls 30-33 and having elongate ribs 36 being conventionally attached to and depending from the flanges 35 of the fuel combustion chamber 29. The elongate ribs 36 are removably received in the longitudinal slots 28 of the fuel-processing assembly 17 to detachably fasten the fuel combustion chamber 29 upon the fuel-processing assembly 17. The fuel combustion chamber further includes a plurality of the pipes 14 in cooperation with connectors such as metal sheets forming the side walls 30-33 and being fluidly and conventionally coupled with one another and with the pipes 14 of the fuel-processing assembly 17, and further includes an opening 34 being disposed through one of the side walls 31 for receiving fuel into the boiler 11.

The upper section 12 include a plurality of panels 37,41-43,83,92 being horizontally positionable and being detachably and conventionally attached to one another and to the lower section 13, and also include a chimney 50 being detachably and conventionally mounted upon the panels 37,41-43, 83,92 and having an exhaust damper 51 being conventionally attached at a top of the chimney 50. The panels 37,41-43 include a first panel 37 with a plurality of the pipes 14 being arranged to form the first panel 37 and with a steam reservoir member 80 conventionally interconnecting the pipes 14 of the first panel 37 with openings 40 being disposed through the first panel 37 between the pipes 14 and the steam reservoir member 80 with a water inlet port 38 being conventionally disposed in one of the pipes 14 and a steam outlet port 39 being conventionally disposed in the steam reservoir member 80 for providing steam to produce usable energy for electricity and to energize devices. The pipes 14 are fluidly and conventionally coupled to one another and to the pipes 14 of the lower section 13. The panels 37,41-43,83,92 also include second panels 41-43 being horizontally disposed and removably and conventionally attached and vertically stacked upon the first panel 37. The second panels 41-43 are formed with the pipes 14 which are conventionally interconnected with pieces of material, and have at least one opening being disposed through the second panels 41-43,83 and between the pipes 14. The at least one opening includes longitudinal slots 44-46 being spacedly disposed through one or more of the second panels 41-43 with blades 47-49 being spacedly and conventionally disposed in the longitudinal slots 44-46 to further conduct heat from burning fuel in the boiler 11 and transferring the heat to the pipes 14. The blades 47-49 are arranged perpendicular to longitudinal edges forming the longitudinal slots 44-46 and are angled at approximately 45 degrees relative to a surface of the second panels 41-43 to optimize conduction of heat.

The exhaust purifying assembly 52 includes an exhaust inlet conduit 53 being conventionally connected and in fluid communication to the upper section 12 of the boiler 11 for transporting exhaust from the boiler 11, and also includes tanks 54A&B being in fluid communication with one another and being formed with a plurality of the pipes 14 being conventionally interconnected with pieces of material with the tanks 54A&B further containing water 56 and being conventionally connected and in fluid communication to the exhaust inlet conduit 53 for receiving the exhaust and extracting pollutants from the exhaust. The exhaust purifying assembly 52 also includes a first tank 54A containing water, and further includes a plurality of filter panels 93 being spacedly arranged in the first tank 54A and being formed by a plurality of pipes 14 for removing pollutants from the exhaust from the boiler 11. The exhaust purifying assembly 52 also includes a second tank 54B being in fluid communication to the first tank 54A and containing water and solid particles 55 such as rock and sand for removing the pollutants from the exhaust, and also includes a plurality of filter grid members 94 being conventionally disposed in the second tank 54B to facilitate the removal of the pollutants from the exhaust. The exhaust purifying assembly 52 further includes an agitator assembly 57 being conventionally mounted to the tanks 54A&B for stirring the water 56 and solid particles 55 to effect removal of the pollutants from the exhaust from the boiler 11, and also includes a water source 82 such as a water reservoir or container being conventionally connected and in fluid communication to the tank 54 for supplying water 56 to the tanks 54A&B. The agitator assembly 57 includes rotatable shafts 58A&B, blades 59A&B being conventionally attached to the rotatable shafts 58A&B for rotation therewith and being removably disposed in the water 56 in the tanks 54A&B for stirring the water 56 and the solid particles 55 and effecting extraction of the pollutants from the exhaust. Motor 60A&B are conventionally connected to the rotatable shafts 58A&B to actuate and effect rotation thereof. A processor 61 is conventionally connected to the motors 60A&B and is programmed to energize the motors 60A&B. The exhaust purifying assembly 52 further includes an exhaust outlet conduit 62 being conventionally connected and in fluid communication to the tanks 54A&B and through which essentially non-pollutant exhaust is carried to the atmosphere, and also includes sensors 63,64 being conventionally disposed in the tanks 54A&B for controlling the water level in the tanks 54A&B and for monitoring the temperature of the water 56 in the tanks 54A&B. The exhaust purifying assembly 52 also includes an exhaust suction member 65 being conventionally connected and in fluid communication to the upper section 12 of the boiler 11 and to the exhaust inlet conduit 53 for drawing exhaust from the boiler 11 into the exhaust inlet conduit 53 and into the tank 54 of water 56. The exhaust suction member 65 includes a rotatable shaft 66 being journaled at a top of the exhaust inlet conduit 53, and also includes a motor 67 being conventionally attached to the rotatable shaft 66 and being conventionally mounted to the exhaust inlet conduit 53, and further includes a turbine 68 being disposed in the exhaust inlet conduit 53 and being conventionally attached to the rotatable shaft 66 for rotation therewith and for drawing exhaust from the boiler 11 through the exhaust inlet conduit 53.

The fuel source assembly 69 includes a support member 70 such as a stand, a ramp 71 being conventionally supported upon the support member 70 and being conventionally connected and in fluid communication to the boiler 11, and a magazine rack 72 being conventionally mounted proximate to the ramp 71 for storing fuel to be used by the boiler 11. The magazine rack 72 includes a plurality of spaced partitions 73 forming channels 74 therebetween designed to support and store columns of fuel 78. The channels 74 have open bottoms through which the fuel 78 is dispensed onto the ramp 71. The fuel source assembly 69 further includes a dispensing valve 75 being movable beneath the magazine rack 72 to open and close the channels 74 in the magazine rack 72 to controllably release the fuel 78 stored in the channels 74 onto the ramp 71, and also includes a motor 76 being conventionally mounted to the ramp 71 and being conventionally connected to the dispensing valve 75 for moving the dispensing valve 75, and further includes a controller 77 being conventionally connected to the motor 76 and being programmed to release the fuel 78 from the magazine rack 72. The ramp 71 is slanted upwardly away from the boiler 11 to gravitationally feed fuel 78 from the magazine rack 72 to the boiler 11. In addition, the ramp 71 has an opening 85 at a bottom end thereof with a motor assembly 86 being conventionally mounted to the ramp 71 and with a push member 87 being conventionally attached to the motor assembly 86 and being movably disposed in the ramp 71 through the opening 85 to facilitate pushing the solid fuel 78 from the ramp into the boiler 11.

In use, a user loads the magazine rack 72 with fuel 78 such as wood logs and programs the controller 77 to periodically energize the motor 76 of the fuel source assembly 69 which actuates the dispensing valve 75 to dispense the fuel 78 onto the ramp 71 which gravitationally feeds the fuel 78 through the opening 34 of the fuel combustion chamber 29 and onto the fuel processing assembly 17; whereupon, the burner burns the fuel 78 creating heat and heated exhaust which heats the pipes 14 in the upper and lower sections 12,13 with the exhaust passing through the openings 40 in the first panel 37 and through the longitudinal slots 44-46 in the second panels 41-43 and with steam being created in the steam reservoir member 80 of the first panel 37 and being used to run a steam turbine which in turn can be used to generate usable electricity. Most of exhaust near the chimney 50 is sucked by the exhaust suction member 65 through the exhaust inlet conduit 53 and into the tank 54 of water 56 containing solid particles 55 to which the pollutants in the exhaust clings to and is extracted from the exhaust and is deposited upon the bottom of the tank 54 to be controllably removed through the drain valve 81 which is conventionally connected to the tank 54. With the pollutants being substantially extracted from the exhaust, the pollution-free exhaust rises through the water 56 in the tank 54 and exits into the atmosphere through the exhaust outlet conduit 62.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the self-sustaining boiler system. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A self-sustaining boiler system comprising:

a boiler capable of generating efficient usable energy and heat, said boiler having upper and lower sections all of which are in fluid communication, and also having a plurality of pipes being disposed in said upper and lower sections with water being carried in said pipes and with said pipes being fluidly coupled throughout said upper and lower sections, said lower section include a fuel processing assembly, a tray being removably disposed beneath said fuel-processing assembly for receiving refuse from burning fuel, and a fuel combustion chamber being detachably mounted upon said fuel-processing assembly, said fuel processing assembly including one or more side walls being detachably attached end to end to form an enclosure having an open top and having flanges being disposed about said open top and having longitudinal slots being disposed there through, said fuel processing assembly also including slides being spaced apart and being detachably attached to said one or more side walls and being disposed within said enclosure, and further including a plurality of said pipes being disposed in and forming said one or more side walls and said slides, said pipes being fluidly coupled to one another with water flowing through said pipes;

an exhaust purifying assembly being in fluid communication to said boiler for removing the pollutants from the exhaust generated by said boiler; and a fuel source assembly being in fluid communication to said boiler for providing fuel to said boiler.

2. The self-sustaining boiler system as described in claim 1, wherein said fuel processing assembly also includes a burner section including at least one torch member being supported upon said enclosure to ignite and burn the fuel.

3. The self-sustaining boiler system as described in claim 2, wherein said fuel processing assembly also includes a refuse removal assembly being disposed near a bottom of said fuel-processing assembly for removing the refuse to said tray.

4. The self-sustaining boiler system as described in claim 3, wherein said refuse removal assembly includes an auger extending within said enclosure and being disposed between and below said slides with said slides being slanted upwardly away from said auger, and also includes an actuator being connected to said auger to energize said auger to remove the refuse to said tray.

5. The self-sustaining boiler system as described in claim 4, wherein said refuse removal assembly further includes a processing unit being connected to said actuator and being programmed to activate and deactivate said actuator for removing the refuse to said tray.

6. The self-sustaining boiler system as described in claim 5, wherein said fuel processing assembly also includes a heating element section being disposed upon said tray, said heating element section including a plurality of said pipes for carrying water and also including at least one heating element being programmed to provide heat to outside means.

7. A self-sustaining boiler system comprising:

a boiler capable of generating efficient usable energy and heat, said boiler having upper and lower sections all of which are in fluid communication, and also having a plurality of pipes being disposed in said upper and lower sections with water being carried in said pipes and with said pipes being fluidly coupled throughout said upper and lower sections, said lower section including a fuel processing assembly, a tray being removably disposed beneath said fuel-processing assembly for receiving refuse from burning fuel, and a fuel combustion chamber being detachably mounted upon said fuel-processing assembly, said fuel combustion chamber including one or more side walls being detachably attached end to end to form a hollow enclosure and being detachably mounted upon and in fluid communication with said fuel-processing assembly, said hollow enclosure having flanges being disposed about an open bottom thereof and about a bottom of said one or more side walls and having elongate ribs depending from said flanges, said elongate ribs being removably received in said longitudinal slots of said fuel-processing assembly to detachably fasten said fuel combustion chamber upon said fuel-processing assembly;

an exhaust purifying assembly being in fluid communication to said boiler for removing the pollutants from the exhaust generated by said boiler; and a fuel source assembly being in fluid communication to said boiler for providing fuel to said boiler.

8. The self-sustaining boiler system as described in claim 7, wherein said fuel combustion chamber further includes a plurality of said pipes being disposed in and forming said one or more side walls and being fluidly coupled with one another and with said pipes of said fuel-processing assembly, and further includes an opening being disposed through said one or more side walls for receiving fuel into said boiler.

9. A self-sustaining boiler system comprising:

a boiler capable of generating efficient usable energy and heat, said boiler having upper and lower sections all of which are in fluid communication, and also having a plurality of pipes being disposed in said upper and lower sections with water being carried in said pipes and with said pipes being fluidly coupled throughout said upper and lower sections;

an exhaust purifying assembly being in fluid communication to said boiler for removing the pollutants from the exhaust generated by said boiler, said exhaust purifying assembly including an exhaust inlet conduit being in fluid communication to said boiler for carrying exhaust from said boiler, and also including at least one tank being formed by a plurality of pipes and containing water and filter means and being in fluid communication to said exhaust input conduit for receiving the exhaust and extracting pollutants from the exhaust; and a fuel source assembly being in fluid communication to said boiler for providing fuel to said boiler.

10. The self-sustaining boiler system as described in claim 9, wherein said at least one tank also includes a first tank containing water, and said exhaust purifying assembly further includes a plurality of filter panels being spacedly arranged in said first tank and being formed by a plurality of said pipes for removing pollutants from the exhaust from the boiler.

11. The self-sustaining boiler system as described in claim 10, wherein said at least one tank further includes a second tank being in fluid communication to said first tank and containing water and solid particles for removing the pollutants from the exhaust, and said exhaust purifying assembly also includes a plurality of filter grid members being disposed in said second tank to facilitate the removal of the pollutants from the exhaust.

12. The self-sustaining boiler system as described in claim 9, wherein said exhaust purifying assembly further includes an agitator assembly being mounted to said at least one tank for stirring the water to effect removal of the pollutants from the exhaust from the boiler, and also includes a water source being in fluid communication to said at least one tank for supplying water to said at least one tank.

13. The self-sustaining boiler system as described in claim 12, wherein said agitator assembly includes at least one rotatable shaft, at least one blade being attached to said at least one rotatable shaft for rotation therewith and being removably disposed in the water in said at least one tank for stirring the water and effecting extraction of the pollutants from the exhaust, at least one motor being connected to said at least one shaft, and a processor being connected to said at least one motor and being programmed to energize said at least one motor.

14. The self-sustaining boiler system as described in claim 13, wherein said exhaust purifying assembly further includes an exhaust outlet conduit being in fluid communication to said at least one tank and through which essentially non-pollutant exhaust is transported, and also includes sensors for monitoring the water level in said at least one tank and for monitoring the temperature of the water in said at least one tank.

15. The self-sustaining boiler system as described in claim 9, wherein said exhaust purifying assembly also includes a suction member being in fluid communication to said upper section of said boiler and to said exhaust inlet conduit for drawing exhaust from said boiler into said exhaust inlet conduit and into said at least one tank of water, and further includes solid particles being disposed in said at least one tank to facilitate removal of the pollutants from the exhaust from said exhaust inlet conduit.

16. The self-sustaining boiler system as described in claim 15, wherein said suction member includes a rotatable shaft being journaled at a top of said exhaust inlet conduit, and also includes a motor being attached to said rotatably shaft and being mounted to said exhaust inlet conduit, and further includes a turbine being disposed in said exhaust inlet conduit and being attached to said rotatable shaft for rotation therewith and for drawing exhaust from said boiler through said exhaust inlet conduit.

* * * * *